US012644162B2

(12) United States Patent
Hellmig et al.

(10) Patent No.: US 12,644,162 B2
(45) Date of Patent: Jun. 2, 2026

(54) METHOD FOR PRODUCING A SCREW, AND SCREW

(71) Applicant: EJOT SE & Co. KG, Bad Berleburg (DE)

(72) Inventors: Ralph J. Hellmig, Bad Laasphe (DE); Michael Achenbach, Breidenbach (DE); Fabian Simonsen, Erfurt (DE)

(73) Assignee: EJOT SE & CO., KG, Bad Berleburg (DE)

( * ) Notice: Subject to any disclaimer, the term of this patent is extended or adjusted under 35 U.S.C. 154(b) by 0 days.

(21) Appl. No.: 17/910,917

(22) PCT Filed: Mar. 16, 2021

(86) PCT No.: PCT/EP2021/056712

§ 371 (c)(1),
(2) Date: Sep. 12, 2022

(87) PCT Pub. No.: WO2021/185853

PCT Pub. Date: Sep. 23, 2021

(65) Prior Publication Data

US 2023/0136145 A1 May 4, 2023

(30) Foreign Application Priority Data

Mar. 16, 2020 (DE) ..... 10 2020 107 194.9

(51) Int. Cl.
*C21D 1/78* (2006.01)
*C21D 1/20* (2006.01)
*C21D 9/00* (2006.01)

(52) U.S. Cl.
CPC ..... *C21D 1/785* (2013.01); *C21D 1/20* (2013.01); *C21D 9/0093* (2013.01);
(Continued)

(58) Field of Classification Search
None
See application file for complete search history.

(56) References Cited

U.S. PATENT DOCUMENTS 4,730,970 A 3/1988 Hyner et al.
5,605,423 A 2/1997 Janusz
(Continued)

FOREIGN PATENT DOCUMENTS

CN 103148076 A 6/2013
CN 104870677 A 8/2015
(Continued)

OTHER PUBLICATIONS

Machine Translation of JP-2014062324-A (Year: 2014).*
(Continued)

*Primary Examiner* — John A Hevey
(74) *Attorney, Agent, or Firm* — Juan Carlos A. Marquez; Marquez IP Law Office, PLLC

(57) ABSTRACT

The invention relates to a method for producing a screw, having the following steps: (a) rolling a screw wire made of low-alloy carbon steel to produce screw (10) having a thread; (b) heating the entire screw (10) to an austenitizing temperature under a carbon atmosphere and/or nitrogen atmosphere and maintaining the temperature; (c) quenching the entire screw (10) to a bainitizing temperature and maintaining the bainitizing temperature until the screw has a bainitic structure over its cross-section. The invention is characterized in that the screw (10) is subsequently hardened locally at its tip (22), by the tip (22) being heated to an austenitizing temperature and the screw (10) being subsequently quenched to a temperature below the martensite starting temperature (MS).

9 Claims, 2 Drawing Sheets

(52) U.S. Cl.
CPC .. *C21D 2211/001* (2013.01); *C21D 2211/002* (2013.01); *C21D 2211/008* (2013.01)

(56) References Cited

U.S. PATENT DOCUMENTS

| | | | | |
|---|---|---|---|---|
| 6,364,972 | B1 * | 4/2002 | Bauer | C21D 9/0093 148/587 |
| 9,145,910 | B2 | 9/2015 | Dieterle et al. | |
| 2003/0147717 | A1 | 8/2003 | Koppel et al. | |
| 2004/0235576 | A1 | 11/2004 | Friederich et al. | |
| 2013/0129446 | A1 * | 5/2013 | Dieterle | C21D 9/0093 411/378 |
| 2015/0344997 | A1 * | 12/2015 | Linden | C21D 9/22 148/587 |
| 2016/0245326 | A1 * | 8/2016 | Pinzl | C23C 8/04 |
| 2018/0031023 | A1 | 2/2018 | Hartmann et al. | |
| 2018/0105905 | A1 | 4/2018 | Linden et al. | |
| 2018/0216652 | A1 | 8/2018 | Wagner et al. | |
| 2020/0300283 | A1 * | 9/2020 | Fröhlich | F16B 37/061 |

FOREIGN PATENT DOCUMENTS

| | | | | |
|---|---|---|---|---|
| CN | 108103297 | A | 6/2018 | |
| DE | 19540848 | A1 | 5/1997 | |
| DE | 10033471 | C1 | 12/2001 | |
| DE | 102010055210 | A1 | 6/2012 | |
| DE | 102017101931 | A1 | 8/2018 | |
| EP | 0563826 | A1 | 10/1993 | |
| EP | 1020536 | A1 | 7/2000 | |
| EP | 1466990 | A1 | 10/2004 | |
| EP | 2594653 | A1 | 5/2013 | |
| EP | 2746419 | A1 | 6/2014 | |
| EP | 3276189 | A1 | 1/2018 | |
| JP | H09263875 | A | 10/1997 | |
| JP | 2011074427 | A | 4/2011 | |
| JP | 2014062324 | A * | 4/2014 | C21D 1/06 |
| JP | 7591061 | B2 | 11/2024 | |
| RU | 2532600 | C1 | 11/2014 | |
| SU | 1731839 | A1 | 5/1992 | |
| TW | 200538215 | A | 12/2005 | |
| WO | 2014040995 | A1 | 3/2014 | |

OTHER PUBLICATIONS

PCT International Preliminary Report on Patentability and Written Opinion dated Sep. 29, 2022 issued in counterpart PCT Application No. PCT/EP2021/056712 (8 pages in English).
Taiwan Office Action mailed Nov. 17, 2022, in counterpart Taiwan application TW202136655A, 4 pages in Chinese.
Taiwan Office Action mailed Nov. 17, 2022, in counterpart Taiwan application TW202136655A, 4 pages English translation.
PCT International Search Report dated May 10, 2021 issued in counterpart PCT Application No. PCT/EP2021/056712 (2 pages in English).
Herstellung von Schrauben und Muttern, https://www.wuerth-iaduslrie.com/web/media/de/pict ures/wuerthindustrie/technikportal/dinokapiteVKap itel_04_DCNO_techn_ Tei l.pdf [retrieved on Jun. 7, 2018] XP055482054, Nov. 18, 2013, 4 pages in German and 4 pages in English.
Japanese Office Action mailed May 7, 2024, in counterpart Japanese application JP2022-554596, 5 pages in Japanese.
Japanese Office Action mailed May 7, 2024, in counterpart Japanese application JP2022-554596, 6 pages in English.
Russian Office Action mailed May 23, 2024 in counterpart Russian application RU2022126719, 8 pages in Russian.
Russian Office Action mailed May 23, 2024 in counterpart Russian application RU2022126719, 7 pages in English.
A choice of the optimum heat treatment mode of the stamping tool from steel KH12MFfor operations of cold deformation, Sotova et al., 7 pages in Russian.
A choice of the optimum heat treatment mode of the stamping tool from steel KH12MFfor operations of cold deformation, Sotova et al., 6 pages in English.
Thailand Office Action mailed Oct. 16, 2025 in counterpart Thailand application TH2201005798, 5 pages in Thai.
Thailand Office Action mailed Oct. 16, 2025 in counterpart Thailand application TH2201005798, 4 pages in English.
Indian Offixe Action mailed Feb. 16, 2026, in counterpart Indian application 202217057471, 10 pages in English.
Chinese Office Action mailed Feb. 15, 2026, in counterpart Chinese application CN202180021299.7, 11 pages in Chinese.
Chinese Office Action mailed Feb. 15, 2026, in counterpart Chinese application CN202180021299.7, 9 pages in English.

* cited by examiner

METHOD FOR PRODUCING A SCREW, AND SCREW

The present application is a National Stage application of PCT international application: PCT/EP2021/056712 filed on Mar. 16, 2021, which claims the benefit of priority from the German Patent Application No. 10 2020 107 194.9, filed on Mar. 16, 2020, both the disclosures of which are hereby incorporated by reference in their entireties.

The invention relates to a method for producing a screw, as specified in the preamble of claim 1, as well as to a screw for direct fastening, as specified in the preamble of claim 5.

EP 3 276 189 A1 describes a screw that has a softer bainitic structure in its edge region along the screw shaft as compared to the screw core. DE 10 2017 101 931 A1 discloses a screw having a bainitic structure in which the bainitic structure is of a lower hardness in the axial direction in the tip of the screw than in a central region located in the direction of the head of the screw.

DE 10 2010 055 210 A1 discloses a method for producing a screw with a double-hardened tip which tip has a higher carbon content than the tempered martensitic shaft region of the screw. As a result, the shaft with the holding region of its thread is less prone to hydrogen embrittlement than the hardened tip of the screw. For this purpose, the tip of a low-alloy carbon screw is partially carburized, then the entire screw is tempered, and subsequently the tip is hardened again locally.

This method is complex and cost-intensive due to the partial carburizing of the screw.

It is the object of the invention to provide a faster and/or more efficient method for producing a screw which method achieves a particularly high degree of hardness in the tip of the screw, and yet a lower degree of hardness in the shaft with its head and holding region, thus making the shaft comparatively less prone to hydrogen embrittlement. The expression 'tip' in the sense of the invention is understood to mean a front region of the screw which extends from the foremost end of the screw in the direction of the screw head. Preferably, this is a region designed to tap a female thread into a female piece which in particular consists of high-strength metallic materials.

The screw according to the invention is manufactured by forming a screw from a low-alloy carbon steel wire that in particular has an alloy content of less than 3% of alloying elements. The thread is rolled onto the screw during manufacture of the latter. The material used for the screw wire is preferably 23MnB4 or 38B2.

The screw is then heated to an austenitizing temperature, with the austenitizing temperature being a temperature at which the respective wire material used is in the austenite phase field of its TTT diagram. In particular, the austenizing temperature is higher than the $A_3$ temperature of the wire material.

After heating the screw to the austenitizing temperature, the screw is quenched to a bainitizing temperature, which temperature is maintained until the screw has a bainitic structure, in particular over the cross-section of the screw shaft. The bainitizing temperature is a temperature at which the wire material is in the bainite phase field. In particular, the quenching time is selected so as to prevent both ferrite and pearlite formation during the quenching process. Quenching is carried out in particular by immersing the screws in a molten salt bath at a bainitizing temperature. A bainite-containing structure is present if a structural section under consideration has a significant and measurable bainite content of in particular more than 25%. A structural section preferably has a size of 0.05 $mm^2$.

In the screw according to the invention, the total area of the structural sections having a bainite content of more than 25% accounts for a surface area proportion of in particular more than 80% of the cross-sectional area of the screw.

According to the invention, after the screw has been kept at a bainitizing temperature for a defined period of time, it is cooled down to below the martensite starting temperature, in particular to room temperature, after which the tip of the screw is heated again locally to an austenitizing temperature. At least the tip of the screw is then quenched again to below the martensite starting temperature, with the quenching time being selected such that ferrite, pearlite and bainite formation is largely prevented.

This results in the tip being hardened again locally, particularly in its edge zone, which means that an ultra-hard tip can be provided.

This ensures that a screw produced according to the invention has low proneness to hydrogen embrittlement in the shaft, but can still have an ultra-hard tip.

According to a preferred embodiment of the invention, heating of the screw to an austenitizing temperature before quenching the screw to a bainitizing temperature can be carried out in a carbon atmosphere having a carbon content higher than the carbon content of the screw, so that a layer is formed in the edge zone of the screw that has a higher carbon content than the core, resulting in a carbon content in the edge zone of the screw that is at least 0.2% higher than in the core zone of the screw. Alternatively, so-called nitriding of the screw can be carried out in a similar way. This is particularly useful for wire materials which have a carbon content of less than 0.4%.

This process, in which carbon or nitrogen is introduced into the screw at austenitizing temperature, followed by quenching to bainitizing temperature, is referred to below as case-hardening bainitizing. A structure produced in this way is referred to as a case-hardened bainitic structure.

Thus, the screw manufactured in this way can have a case-hardened bainitic structure in its shaft and its head region, in particular in the edge zone, and an ultra-hard martensitic structure in its tip, in particular in the edge zone of its tip. In particular, the edge zone has a carbon content of between 0.6% and 1.5%.

For direct fastening, the screw according to the invention thus exhibits both a high degree of hardness in its tip and a high degree of ductility in its shaft, which latter moreover exhibits low proneness to hydrogen embrittlement.

According to a further embodiment of the invention, the screw can be tempered after case-hardening bainitizing and after hardening of the tip.

Preferably, the tempering process may be performed together with a coating process. In particular, the coating may be zinc flake coating.

In another aspect thereof, the invention relates to a screw having a shaft comprising the screw head and a tip comprising the opposite end of the screw, wherein the shaft has a substantially bainitic structure over its cross-section and, according to the invention, the screw has a tip with a martensitic edge zone.

In particular, the edge zone has a higher carbon content than the core, with the difference in concentration being at least 0.2%.

The shaft may have a substantially tempered bainitic structure in its core and a tempered structure in its edge zone, which latter structure has a higher carbon content than the core. The tip may have a tempered hardened martensitic structure at least in its edge zone.

The screw according to the invention is preferably produced using the method described above.

Additional advantages, features and possible applications of the present invention will become apparent from the following description in which reference is made to the embodiments illustrated in the drawings.

Figure 1:
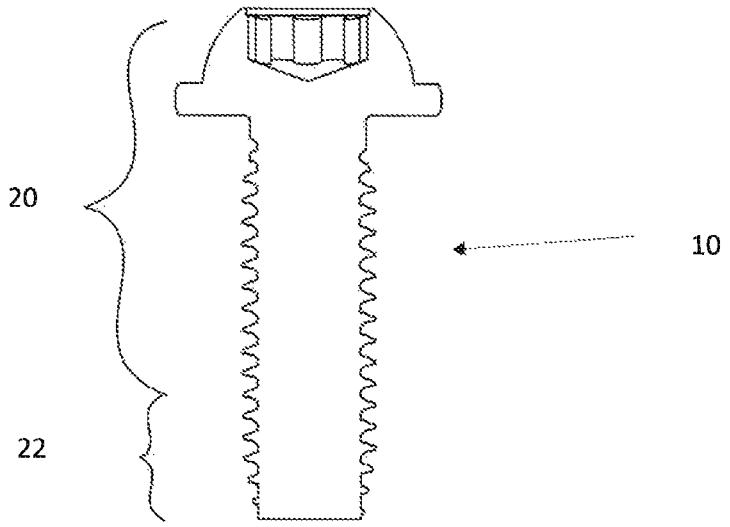
FIG. 1 is a schematic sectional view of a low-alloy carbon steel screw manufactured by rolling the screw thread onto the shaft.

FIG. 1 is a schematic sectional view of a rolled screw 10 made of conventional screw steel after a process step. The screw has a shaft 20 comprising the screw head and a free screw end which is referred to here as the tip 22 and is located opposite the head in the axial direction. The screw according to the invention is manufactured by forming, in a process step, the screw from a screw wire of low-alloy carbon steel having an alloy content of less than 3% of alloying elements. Manufacture of the screw in particular involves rolling the thread onto the screw. Preferably, 23MnB4 is used as the material for the screw wire. This kind of steel can be processed well in a rolling process.

Figure 2:
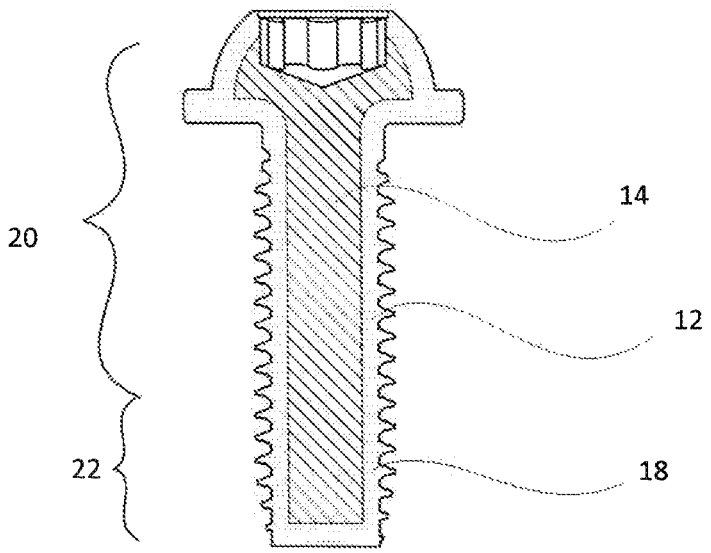
FIG. 2 is a schematic sectional view of the screw after case-hardening bainitizing.

FIG. 2 is a schematic sectional view of the screw 10.

To achieve the state illustrated in FIG. 2, the screw 10 was heated to an austenitizing temperature in a carbon atmosphere having a higher carbon content than the screw 10 itself and exposed to this carbon atmosphere until a carbon content was reached in the edge zone 12 of the shaft and in the edge zone 18 of the tip of the screw 10 which is at least 0.2% higher than that in the core of the screw, and which in particular is between 0.6% and 1.5%. In the present view, edge zone 12 and edge zone 18 are only schematically illustrated and may vary in depth. As an alternative or in addition to carburizing, nitriding can also take place analogously.

After reaching the desired carbon saturation in edge zone 12 and edge zone 18, the screw 10 is quenched, in particular in a molten salt bath, to a bainitizing temperature, which bainitizing temperature is above the martensite starting temperature Ms. The screw is kept at bainitizing temperature until its shaft substantially has a bainitic structure 14 over its cross-sectional area. The screw 10, according to FIG. 2, has a higher carbon content in edge layer 12 and edge layer 18 than the core. A substantially bainitic structure is defined as at least 80% of the cross-sectional area having a bainitic structure. Other structures may also be present in some cases.

Figure 3:
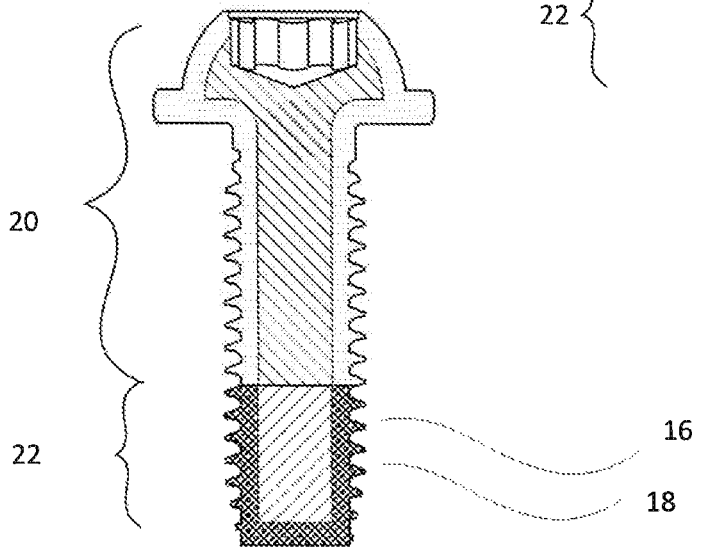
FIG. 3 is a schematic sectional view of the screw after local case hardening of the tip.

FIG. 3 is a schematic sectional view of a screw 10 according to the invention, in which the tip 22 of the screw has been heated again locally to an austenitizing temperature and then cooled down to a temperature below the martensite starting temperature Ms to form martensite, so that a hardened martensitic microstructure 16 with a carbon content of about 1% is present in the tip 22, in particular in the edge layer 18. This results in the creation of an ultra-hard tip.

Figure 4:
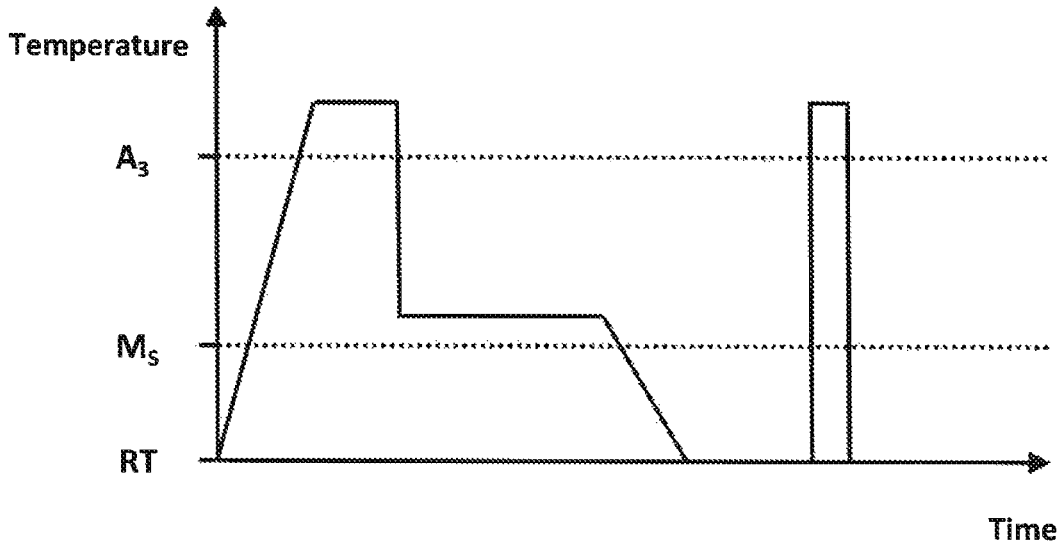
FIG. 4 is a schematic temperature-time diagram of the method according to the invention for producing the screw and case hardening of the tip.

FIG. 4 is a schematic temperature-time diagram of the manufacturing method according to the invention. The screw is first heated to an austenitizing temperature that is higher than the $A_3$ temperature. If the wire material does not have a sufficient carbon content of between 0.6% and 1.5%, such heating can be performed in a carbon enriching atmosphere. The carbon content of the atmosphere has a higher carbon concentration than the wire material, so that carbon will diffuse from the carbon atmosphere into the edge zone of the screw during heating.

The screw is then quenched to a bainitizing temperature. The bainitizing temperature is the temperature at which the wire material is in the bainite phase field of its time-temperature diagram. The quenching time is selected to prevent both ferrite and pearlite formation during the quenching process. The screw is held at the bainitizing temperature until substantial portions of the cross-section of the screw exhibit a bainite structure. The screw is then cooled down to room temperature.

After the screw manufactured in this way has been cooled down to room temperature RT, its tip is locally reheated to an austenitizing temperature and then quenched again to below the martensite starting temperature Ms so that a martensitic structure is formed at least in the edge zone of the tip.

The invention claimed is:

1. A screw formed from low alloy carbon steel comprising a thread-bearing shaft, a tip, a core and an edge zone, wherein the edge zone of the screw has an edge zone of the thread-bearing shaft and an edge zone of the tip, the thread-bearing shaft consisting of a bainitic structure over an entire cross-section, the edge zone of the thread-bearing shaft having a bainitic structure and a higher carbon content than the core, and wherein at least the edge zone of the tip substantially consists of a hardened martensitic structure, the edge zone of the tip having a higher carbon content than a core of the tip, wherein an alloy content of the low alloy carbon steel is less than 3%.

2. The screw according to claim 1, wherein the screw is produced using a method comprising the steps of rolling a screw wire made of low-alloy carbon steel to produce a screw having a thread; heating the entire screw to an austenitizing temperature under a carbon atmosphere and maintaining the temperature; quenching the entire screw to a bainitizing temperature and maintaining the bainitizing temperature until the screw has a bainitic structure over an entire cross-section thereof, wherein the screw is subsequently hardened locally at the tip by the tip being heated to an austenitizing temperature and the screw being subsequently quenched to a temperature below a martensite starting temperature Ms.

3. The screw according to claim 2, wherein at least one of the carbon atmosphere has a higher carbon content than the screw and the nitrogen atmosphere has a higher nitrogen content than the screw.

4. The screw according to claim 2, wherein the screw is kept at an austenitizing temperature in the carbon atmosphere until the edge zone of the screw has a carbon content which is at least 0.2% higher than a carbon content of the core of the screw.

5. The screw according to claim 2, wherein the screw is tempered.

6. The screw according to claim 2, wherein the edge zone of the thread-bearing shaft is a bainitic structure and has a higher carbon content than the core, and at least an edge zone of the tip consists of a hardened martensitic structure with a higher carbon content than the core.

7. The screw according to claim 5, wherein the edge zone of the thread-bearing shaft is of a bainitic structure and has a higher carbon content than the core, and at least an edge zone of the tip consists of a hardened martensitic structure with a higher carbon content than the core.

8. The screw according to claim 1, wherein the low alloy carbon steel is comprised of at least one of 23MnB4 and 38B2 steel.

9. A screw formed from low alloy carbon steel comprising a thread-bearing shaft, a tip, a core and an edge zone, wherein the edge zone of the screw has an edge zone of the thread-bearing shaft and an edge zone of the tip, the thread-bearing shaft consisting of a bainitic structure over an entire cross-section, the edge zone of the thread-bearing shaft having a bainitic structure and a higher carbon content than the core, and wherein at least the edge zone of the tip substantially consists of a hardened martensitic structure, the edge zone of the tip having a higher carbon content than a core of the tip, wherein the low alloy carbon steel is formed from at least one of 23MnB4 and 38B2 steel.

* * * * *